US010517145B2

(12) United States Patent
Ma

(10) Patent No.: US 10,517,145 B2
(45) Date of Patent: Dec. 24, 2019

(54) CHEMICAL LIQUID THERMOSTAT CONTROL DEVICE

(71) Applicant: WUHAN CHINA STAR OPTOELECTRONICS TECHNOLOGY CO., LTD., Wuhan, Hubei (CN)

(72) Inventor: Di Ma, Hubei (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 509 days.

(21) Appl. No.: 15/333,444

(22) Filed: Oct. 25, 2016

(65) Prior Publication Data

US 2017/0290094 A1 Oct. 5, 2017

(30) Foreign Application Priority Data

Mar. 30, 2016 (CN) ..... 2016 1 0191156

(51) Int. Cl.
*H05B 1/00* (2006.01)
*H05B 3/10* (2006.01)
(Continued)

(52) U.S. Cl.
CPC ..... *H05B 1/0244* (2013.01); *H05B 1/025* (2013.01)

(58) Field of Classification Search
CPC ... B60H 1/00314; F24D 3/02; F24D 17/0026; H05B 1/00–0202; H05B 1/0227–023;
(Continued)

(56) References Cited

U.S. PATENT DOCUMENTS 4,604,516 A * 8/1986 Metz ..... F24H 9/2071 219/499
4,818,842 A * 4/1989 Walty ..... F02M 31/125 219/205

(Continued)

FOREIGN PATENT DOCUMENTS

CN 101513317 A 8/2009
CN 201926129 U 8/2011

(Continued)

*Primary Examiner* — Michael A Laflame, Jr.

(74) *Attorney, Agent, or Firm* — Muncy, Geissler, Olds & Lowe, P.C.

(57) ABSTRACT

A chemical liquid thermostat control device is provided, and has a chemical tank for accommodating a chemical liquid, PTC resistor patterns for heating and maintaining the chemical liquid in a constant temperature, a current limit circuit for controlling the PTC resistor patterns to heat or to stop heating according to a real-time resistance value of each of the PTC resistor patterns, so as to maintain the chemical liquid at the constant temperature. The PTC resistor patterns are uniformly spaced in the chemical tank and immersed in the chemical liquid. Each of the PTC resistor patterns is connected with the current limit circuit through a wire. A heating power of a heating device can be real-time adjusted for intelligently heating. Thus, it is safer and a fire risk can be prevented. The life time of the PTC resistor patterns is more than a decade, and doesn't need be replaced frequently.

8 Claims, 2 Drawing Sheets

(51) Int. Cl.
*H05B 3/78* (2006.01)
*H05B 1/02* (2006.01)

(58) Field of Classification Search
CPC ..... H05B 1/0236; H05B 3/10–141; H05B 3/20–24; H05B 3/40–42; H05B 3/78–82
See application file for complete search history.

(56) References Cited

U.S. PATENT DOCUMENTS 4,849,611 A * 7/1989 Whitney ..... H05B 3/141 219/538
4,972,067 A * 11/1990 Lokar ..... H05B 3/14 219/505
5,609,297 A * 3/1997 Gladigow ..... F02M 31/125 123/298
6,037,567 A * 3/2000 Inoue ..... B60H 1/2225 165/299
6,078,024 A * 6/2000 Inoue ..... B60H 1/2218 165/299
6,080,973 A * 6/2000 Thweatt, Jr. ..... F24H 9/0047 219/497
6,222,989 B1 * 4/2001 Lee ..... A01M 1/2077 219/538
7,034,259 B1 * 4/2006 Lokar ..... H05B 3/44 219/538
2001/0043808 A1 * 11/2001 Matsunaga ..... B60H 1/00792 392/494
2005/0058865 A1 * 3/2005 Thompson ..... H01M 8/0258 429/429
2009/0263114 A1 * 10/2009 Wu ..... B60S 1/487 392/479
2013/0125531 A1 * 5/2013 Choi ..... F01N 3/2066 60/274
2013/0129331 A1 * 5/2013 de Souza ..... A61D 19/025 392/445
2013/0186966 A1 * 7/2013 Taguchi ..... B60H 1/2221 237/57
2015/0034626 A1 * 2/2015 Kominami ..... H05B 1/0236 219/483
2015/0285119 A1 * 10/2015 Bauer ..... F01N 3/2066 392/441
2017/0295613 A1 * 10/2017 Kim ..... B60H 1/00392

FOREIGN PATENT DOCUMENTS

CN 203240741 U 10/2013
CN 204187854 U 3/2015
CN 204446256 U 7/2015

* cited by examiner

CHEMICAL LIQUID THERMOSTAT CONTROL DEVICE

FIELD OF THE INVENTION

The present invention relates to a liquid thermostat field, and more particularly to a chemical liquid thermostat control device.

BACKGROUND OF THE INVENTION

Currently, during the production of the wet process equipment in the panel production, it is necessary to use a chemical tank to supply chemical liquid having an accurate temperature to the wet process equipment. The temperature control of the chemical liquid is completed in the chemical tank. The conventional chemical tank comprises four devices: a process cooling water system for a cooling effect, a heating rod for heating, a circulating pump for distributing the chemical liquid evenly and a temperature detecting sensor for making feedback a current temperature of the chemical liquid. These four devices are configured for controlling a specific temperature of the chemical liquid by PID control.

The methods of conventional technology have the following drawbacks. First, when the heating rods are operated, a partial temperature usually reaches 200 or more, the chemical liquid can only be uneven heat exchanged on a surface of the heating rod. Second, the partial temperature of the heating rods is excessively high so that the organically chemical liquid has a risk of fire. Third, PID is configured for controlling the working of the process cooling water system and the heating rods to complete the temperature control through the feedback of the temperature detecting sensor, which results in waste of energy. Fourth, the heating rods belong to a partial heating manner and the heating power is not adjustable during heating. Fifth, the life time of the heating rods is short. The above-mentioned drawbacks of the conventional technology need to be solved.

SUMMARY OF THE INVENTION

An object of the present invention is to provide a chemical chemical liquid thermostat control device for solving the drawbacks of the conventional technology including when the heating rods are configured for heating the chemical liquid, the chemical liquid can only be uneven heat exchanged on a surface of the heating rod, the partial temperature of the heating rods is excessively high so that the organically chemical liquid has a risk of fire, the heating rods belong to a partial heating manner and the heating power is not adjustable during heating, and the life time of the heating rods is short.

The technical solution of the present invention is provided as follows.

A chemical liquid thermostat control device, comprises:

a chemical tank configured to accommodate a chemical liquid;

a plurality of PTC resistor patterns configured to heat the chemical liquid and maintain the chemical liquid in a constant temperature;

a current limit circuit configured to control the PTC resistor patterns to heat or to stop heating according to a real-time resistance value of each of the PTC resistor patterns, so as to maintain the chemical liquid at the constant temperature;

the PTC resistor patterns are uniformly spaced in the chemical tank and are immersed in the chemical liquid, each of the PTC resistor patterns is connected with the current limit circuit through a wire.

Preferably, the chemical liquid thermostat control device further comprises a constant voltage power connecting with the current limit circuit, so as to transmit power to the current limit circuit.

Preferably, the chemical liquid thermostat control device further comprises a circulating pump. An inlet pipe of the circulating pump is interconnected with a bottom of the chemical tank, and an outlet pipe of the circulating pump is interconnected with a top of the chemical tank.

Preferably, the current limit circuit comprises:

a plurality of MOS switching circuits correspondingly connected with the PTC resistor patterns to control a working status of the PTC resistor patterns;

a plurality of driving circuits correspondingly connected with the MOS switching circuits to control the MOS switching circuits to be on and off;

a voltage measuring circuit respectively connected to the driving circuits and a single-chip microcomputer to measure real-time voltage value of each of the PTC resistor patterns;

a current measuring circuit respectively connected with the PTC resistor patterns and the single-chip microcomputer to measure a real-time current value of each of the PTC resistor patterns;

a transformer respectively connected with the constant voltage power, the driving circuits and the single-chip microcomputer to convert a voltage of the constant voltage power into a voltage range applied to the driving circuits and the single-chip microcomputer;

the single-chip microcomputer respectively connected with the driving circuits, the voltage measuring circuit, the current measuring circuit, and the transformer to control the voltage measuring circuit and the current measuring circuit and respectively obtaining the real-time voltage value and the real-time current value of each of the PTC resistor patterns, thereby calculating the real-time resistance value of each of the PTC resistor patterns, and further to control a current level of each of the PTC resistor patterns, so as to maintain the chemical liquid in a constant temperature.

Preferably, a signal transmission direction between the voltage measuring circuit and the single-chip microcomputer is a unidirectional transmission, and the signal transmission direction is from the voltage measuring circuit to the single-chip microcomputer.

Preferably, a signal transmission direction between the current measuring circuit and the single-chip microcomputer is a unidirectional transmission, and the signal transmission direction is from the current measuring circuit to the single-chip microcomputer.

Preferably, a signal transmission direction between the driving circuits and the single-chip microcomputer is a unidirectional transmission, the signal transmission direction is from the single-chip microcomputer to the driving circuits.

Preferably, when a temperature of the PTC resistor pattern is higher than its Curie temperature, the single-chip microcomputer controls the driving circuits to turn off the MOS switching circuits. When the temperature of the PTC resistor pattern is lower than its Curie temperature, the single-chip microcomputer controls the driving circuits to turn on the MOS switching circuits.

Preferably, the single-chip microcomputer controls the driving circuits by generating a pulse width modulation signal with a variable duty cycle.

Preferably, the Curie temperature of the PTC resistor pattern is 60° C.

The technical effect of the present invention is provided as follows.

The present invention provides a chemical liquid thermostat control device. The single-chip microcomputer is used for controlling the voltage measuring circuit and the current measuring circuit and respectively obtaining the real-time voltage value and the real-time current value of each of the PTC resistor patterns, thereby calculating the real-time resistance value of each of the PTC resistor patterns, and further for controlling a current level of each of the PTC resistor patterns, so as to maintain the chemical liquid at a constant temperature. Thus, a heating power of a heating device can be adjusted in real-time for intelligently heating, which is safer and prevents the fire risk. The life time of the PTC resistor patterns is more than a decade and does not need be replaced frequently.

DESCRIPTION OF THE DRAWINGS

In order to more clearly describe the embodiments of the present invention or the conventional technical solutions, the description is used to make a simple introduction of the drawings used in the following embodiments. Obviously, the following descriptions of the drawings are merely some embodiments of the present invention, those of ordinary skill in the art can also obtain other drawings based on these drawings without creative effort.

DETAILED DESCRIPTION OF THE PREFERRED EMBODIMENTS

In the following detailed description of the preferred embodiments, reference is made to the accompanying drawings which form a part hereof, and as shown by way of illustration specific embodiments in which the invention may be practiced. Obviously, the following descriptions of the drawings are merely some embodiments of the present invention, not all of the embodiments of the present invention. Based on the embodiments of the present invention, other embodiments obtained from those of ordinary skill in the art based on these description and drawings without creative effort are belonging to the scope of the present invention.

Embodiment 1

PTC is an abbreviation of Positive Temperature Coefficient, which defines a positive temperature coefficient and refers to semiconductor materials or components having a great positive temperature coefficient. Typically, the PTC mentioned herein refers to a temperature coefficient thermistor, also called PTC thermistor, which is a semiconductor resistance with temperature sensitivity. When a temperature exceeds a certain temperature (Curie temperature), a resistance value of the semiconductor resistance increases with increasing temperature in a stepwise manner.

Figure 1:
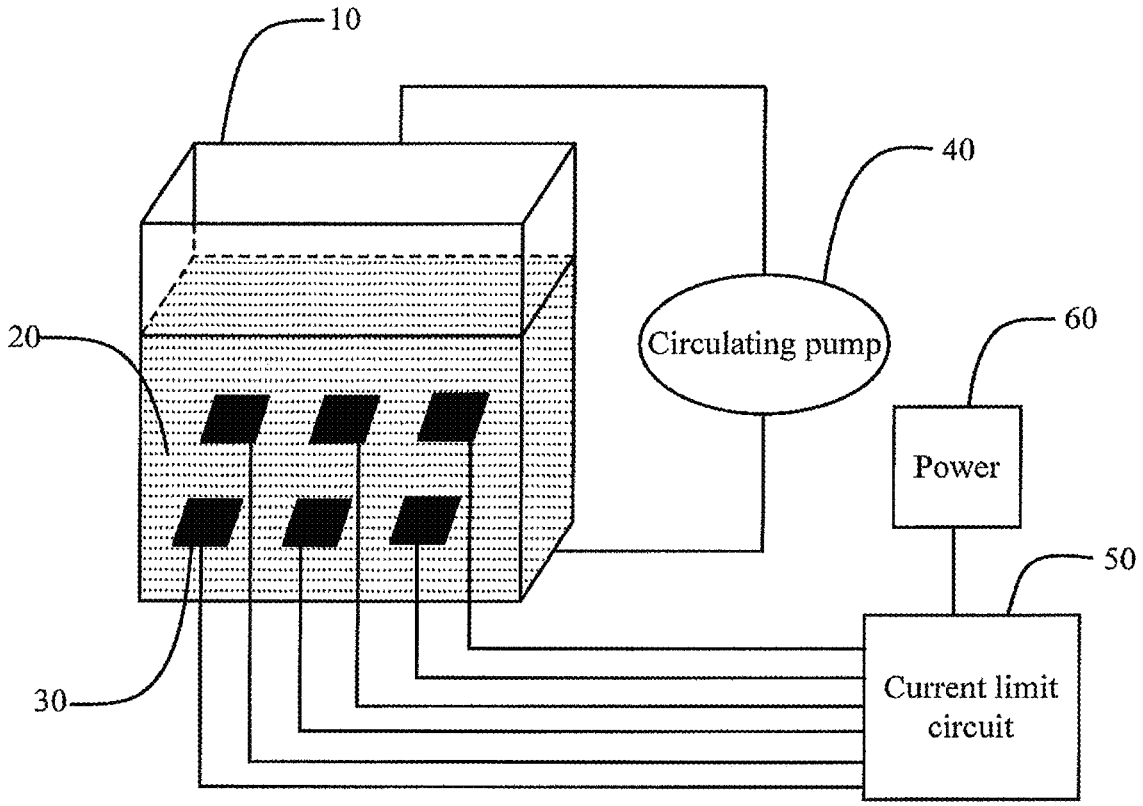
FIG. 1 is an overall structural schematic view of a chemical liquid thermostat control device according to an embodiment of the present invention.

Refer to FIG. 1, which is an overall structural schematic view of a chemical liquid 20 thermostat control device according to an embodiment of the present invention. As shown in FIG. 1, the embodiment of the present invention provides a chemical liquid thermostat control device 20, which comprises:

a chemical tank 10 configured for accommodating the chemical liquid 20.

A plurality of PTC resistor patterns 30 are configured for heating the chemical liquid 20 and maintaining the chemical liquid 20 at a constant temperature.

A current limit circuit 50 is configured for controlling the PTC resistor patterns 30 to heat or to stop heating according to a real-time resistance value of each of the PTC resistor patterns 30, so as to maintain the chemical liquid 20 at the constant temperature. The current limit circuit 50 is configured as a control function.

The PTC resistor patterns 30 are uniformly spaced in the chemical tank 10 and are immersed in the chemical liquid 20, each of the PTC resistor patterns 30 is connected with the current limit circuit 50 through a wire.

In the embodiment, the chemical liquid thermostat control device further comprises a constant voltage power 60 connecting with the current limit circuit 50 for transmitting power to the current limit circuit 50.

In the embodiment, the chemical liquid thermostat control device further comprises a circulating pump 40. An inlet pipe of the circulating pump 40 is interconnected with a bottom of the chemical tank 10, and an outlet pipe of the circulating pump 40 is interconnected with a top of the chemical tank 10. The circulating pump 40 is configured as a function of keeping the chemical liquid 20 circulating constantly, so that the temperature of the chemical liquid 20 is more even.

Figure 2:
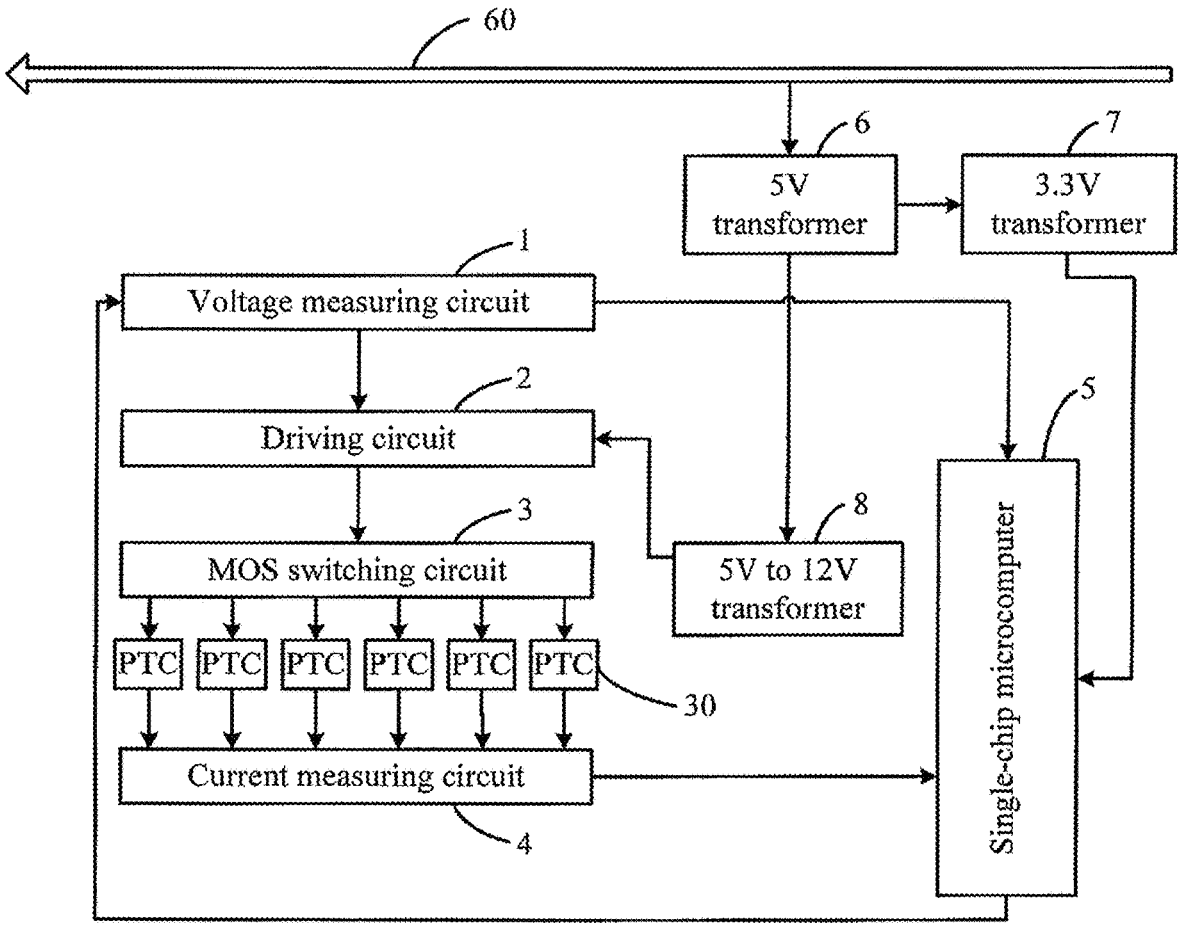
FIG. 2 is a framework schematic view of a circuit structure of the chemical liquid thermostat control device according to the embodiment of the present invention.

Refer to FIG. 2, which is a framework schematic view of a circuit structure of the chemical liquid thermostat control device according to the embodiment of the present invention. In the embodiment, the current limit circuit 50 comprises:

a plurality of MOS switching circuits 3 correspondingly connected with the PTC resistor patterns 30 for controlling a working status of the PTC resistor patterns.

A plurality of driving circuits 2 are correspondingly connected with the MOS switching circuits 3 for controlling the MOS switching circuits 3 on and off.

A voltage measuring circuit 1 is connected to the driving circuits 2 and a single-chip microcomputer 5 respectively for measuring a real-time voltage value of each of the PTC resistor patterns 30.

A current measuring circuit 4 is connected with the PTC resistor patterns 30 and the single-chip microcomputer 5 respectively for measuring a real-time current value of each of the PTC resistor patterns 30.

A transformer is connected with the constant voltage power 60, the driving circuits 2 and the single-chip microcomputer 5 respectively for converting a voltage of the constant voltage power 60 into a voltage range applied for the driving circuits 2 and the single-chip microcomputer 5.

In the embodiment, the transformer comprises:

a 5V transformer 6 connected with the constant voltage power 60 for supplying power to a 3.3V transformer 7 and a 5V to 12V transformer 8.

The 3.3V transformer 7 is connected with the 5V transformer 6 and the single-chip microcomputer 5 respectively for supplying power to the single-chip microcomputer 5.

The 5V to 12V transformer 8 is connected with the 5V transformer 6 and driving circuits 2 respectively for supplying power to the driving circuits 2.

Moreover, part of circuits of the 5V to 12V transformer 8 are configured as a MOS gate of the MOS switching circuits 3, as shown in FIG. 2.

The single-chip microcomputer 5 is connected with the driving circuits 2, the voltage measuring circuit 1, the current measuring circuit 4, and the transformer respectively for controlling the voltage measuring circuit 1 and the current measuring circuit 4 and respectively obtaining the real-time voltage value and the real-time current value of each of the PTC resistor patterns 30, thereby calculating the real-time resistance value of each of the PTC resistor patterns 30, and further for controlling a current level of each of the PTC resistor patterns 30, so as to maintain the chemical liquid 20 at a constant temperature.

In the embodiment, a signal transmission direction between the current measuring circuit 1 and the single-chip microcomputer 5 is a unidirectional transmission, the signal transmission direction is from the current measuring circuit 1 to the single-chip microcomputer 5.

In the embodiment, a signal transmission direction between the current measuring circuit 4 and the single-chip microcomputer 5 is a unidirectional transmission, the signal transmission direction is from the current measuring circuit 4 to the single-chip microcomputer 5.

In the embodiment, a signal transmission direction between the driving circuits 2 and the single-chip microcomputer 5 is a unidirectional transmission, the signal transmission direction is from the single-chip microcomputer 5 to the driving circuits 2.

In the embodiment, when a temperature of the PTC resistor pattern 30 is higher than its Curie temperature, the single-chip microcomputer 5 controls the driving circuits 2 to turn off the MOS switching circuits 3. When the temperature of the PTC resistor pattern 30 is lower than its Curie temperature, the single-chip microcomputer 5 controls the driving circuits 2 to turn on the MOS switching circuits 3.

In the embodiment, the single-chip microcomputer 5 controls the driving circuits 2 by generating a pulse width modulation signal with a variable duty cycle.

In the embodiment, the Curie temperature of the PTC resistor pattern 30 is 60° C.

Working principles of the present invention are as follows:

As shown in FIG. 2, it is assumed that the PTC resistor patterns 30 are in an amount of 6. The single-chip microcomputer 5 controls the circuit operation of the whole system, and calculates the real-time resistance value of the PTC resistor patterns 30 through the current measuring circuit 1 and measures the current value of each of the PTC resistor patterns 30 through the six current measuring circuits 4. The data is processed by the single-chip microcomputer 5. According to Ohm's law, the real-time resistance value of each of the PTC resistor patterns 30 is calculated. According to the real-time resistance value, the single-chip microcomputer 5 generates a PWM signal having corresponding pulse width, i.e., a pulse width modulation signal. That is, the six driving circuits 2 are adjusted for turning on or turning off the six MOS switches, thereby controlling the current passing through each of the PTC resistor patterns 30 to limit the current.

For example, the chemical liquid 20 in the chemical tank 10 is at a lower temperature, the temperature of the PTC resistor patterns are getting lower, while its own resistance will be reduced. When the voltage is maintained constant, it causes the current passing through the PTC resistor patterns 30 to be increased, thereby a heating power of the PTC resistor patterns 30 is increased and the temperature of the chemical liquid 20 is increased. Thus, when the resistance value of the PTC resistor patterns 30 is less than a predetermined temporary state, the single-chip microcomputer 5 does not limit the current passing therethrough. At this time, the single-chip microcomputer 5 controls the driving circuit 2, so that a duty cycle of the PWM signal is 100%. Conversely, when the chemical liquid 20 temperature is too high, the resistance of the PTC resistor patterns 30 becomes large, i.e., causing the current passing through the PTC resistor patterns 30 being decreased. In order to prevent the temperature of chemical liquid 20 from further increasing, the single-chip microcomputer 5 controls the driving circuit 2, so that the duty cycle of the PWM signal is gradually reduced until 0% for gradually decreasing the current passing through the PTC resistor patterns 30 until the current becomes zero. These are the current limit circuit 50 operating states.

The present invention provides a chemical liquid thermostat control device. The single-chip microcomputer is used for controlling the voltage measuring circuit and the current measuring circuit and respectively obtaining the real-time voltage value and the real-time current value of each of the PTC resistor patterns, thereby calculating the real-time resistance value of each of the PTC resistor patterns, and further for controlling a current level of each of the PTC resistor patterns, so as to maintain the chemical liquid at a constant temperature. Thus, a heating power of a heating device can be real-time adjustment for intelligently heating, which is safer and prevents the fire risk. The life time of the PTC resistor patterns is more than a decade and does not need be replaced frequently.

The embodiments of present invention provide a chemical liquid 20 thermostat control device mentioned above. The present invention has been described with preferred embodiments thereof, and it is understood that many changes and modifications to the described embodiments can be carried out without departing from the scope and the spirit of the invention that is intended to be limited only by the appended claims.

What is claimed is:

1. A chemical liquid thermostat control device, comprising:

a chemical tank configured to accommodate a chemical liquid;

a plurality of PTC resistor patterns configured to heat the chemical liquid and maintain the chemical liquid at a constant temperature;

a current limit circuit configured to control the PTC resistor patterns to heat or to stop heating according to a real-time resistance value of each of the PTC resistor patterns, so as to maintain the chemical liquid at the constant temperature; and a constant voltage power connected with the current limit circuit, so as to transmit power to the current limit circuit;

wherein the PTC resistor patterns are uniformly spaced in the chemical tank and are immersed in the chemical liquid, and each of the PTC resistor patterns is connected with the current limit circuit through a wire; and wherein the current limit circuit comprises:

a plurality of MOS switching circuits correspondingly connected with the PTC resistor patterns to control a working status of the PTC resistor patterns;

a plurality of driving circuits correspondingly connected with the MOS switching circuits to control the MOS switching circuits to be on and off;

a voltage measuring circuit respectively connected to the driving circuits and a single-chip microcomputer to measure a real-time voltage value of each of the PTC resistor patterns;

a current measuring circuit respectively connected with the PTC resistor patterns and the single-chip microcomputer to measure a real-time current value of each of the PTC resistor patterns;

a transformer respectively connected with the constant voltage power, the driving circuits and the single-chip microcomputer to convert a voltage of the constant voltage power into a voltage range applied to the driving circuits and the single-chip microcomputer; and the single-chip microcomputer respectively connected with the driving circuits, the voltage measuring circuit, the current measuring circuit, and the transformer to control the voltage measuring circuit and the current measuring circuit and respectively obtaining the real-time voltage value and the real-time current value of each of the PTC resistor patterns, thereby calculating the real-time resistance value of each of the PTC resistor patterns, and further to control a current level of each of the PTC resistor patterns, so as to maintain the chemical liquid at a constant temperature.

2. The chemical liquid thermostat control device according to claim 1, further comprising a circulating pump, an inlet pipe of the circulating pump interconnected with a bottom of the chemical tank, and an outlet pipe of the circulating pump interconnected with a top of the chemical tank.

3. The chemical liquid thermostat control device according to claim 1, wherein a signal transmission direction between the voltage measuring circuit and the single-chip microcomputer is a unidirectional transmission, and the signal transmission direction is from the voltage measuring circuit to the single-chip microcomputer.

4. The chemical liquid thermostat control device according to claim 1, wherein a signal transmission direction between the current measuring circuit and the single-chip microcomputer is a unidirectional transmission, and the signal transmission direction is from the current measuring circuit to the single-chip microcomputer.

5. The chemical liquid thermostat control device according to claim 1, wherein a signal transmission direction between the driving circuits and the single-chip microcomputer is a unidirectional transmission, and the signal transmission direction is from the single-chip microcomputer to the driving circuits.

6. The chemical liquid thermostat control device according to claim 1, wherein when a temperature of the PTC resistor pattern is higher than its Curie temperature, the single-chip microcomputer controls the driving circuits to turn off the MOS switching circuits; and when the temperature of the PTC resistor pattern is lower than its Curie temperature, the single-chip microcomputer controls the driving circuits to turn on the MOS switching circuits.

7. The chemical liquid thermostat control device according to claim 6, wherein the single-chip microcomputer controls the driving circuits by generating a pulse width modulation signal with a variable duty cycle.

8. The chemical liquid thermostat control device according to claim 1, wherein the Curie temperature of the PTC resistor pattern is 60° C.

* * * * *